US011170918B2

(12) United States Patent
Ushiyama et al.

(10) Patent No.: US 11,170,918 B2
(45) Date of Patent: Nov. 9, 2021

(54) CHIP RESISTOR AND CHIP RESISTOR PRODUCTION METHOD

(71) Applicant: KOA CORPORATION, Ina (JP)

(72) Inventors: Kazuhisa Ushiyama, Ina (JP); Natsuki Iguchi, Ina (JP); Yasuhiro Kamijo, Ina (JP); Hisakazu Nagata, Ina (JP)

(73) Assignee: KOA CORPORATION, Ina (JP)

( * ) Notice: Subject to any disclaimer, the term of this patent is extended or adjusted under 35 U.S.C. 154(b) by 0 days.

(21) Appl. No.: 17/049,486

(22) PCT Filed: Apr. 8, 2019

(86) PCT No.: PCT/JP2019/015269
§ 371 (c)(1),
(2) Date: Oct. 21, 2020

(87) PCT Pub. No.: WO2019/220811
PCT Pub. Date: Nov. 21, 2019

(65) Prior Publication Data

US 2021/0249164 A1 Aug. 12, 2021

(30) Foreign Application Priority Data

May 17, 2018 (JP) ..... JP2018-095499

(51) Int. Cl.
*H01C 17/00* (2006.01)
*H01C 17/242* (2006.01)

(52) U.S. Cl.
CPC ..... *H01C 17/006* (2013.01); *H01C 17/242* (2013.01)

(58) Field of Classification Search
CPC ..... H01C 17/006; H01C 17/242; H01C 10/18
See application file for complete search history.

(56) References Cited

U.S. PATENT DOCUMENTS 4,041,440 A * 8/1977 Davis ..... H01C 1/16 338/195
4,146,867 A * 3/1979 Blangeard ..... H01C 7/22 338/195

(Continued)

FOREIGN PATENT DOCUMENTS

JP H09-205004 A 8/1997
JP 2001-338801 A 12/2001

*Primary Examiner* — Kyung S Lee
(74) *Attorney, Agent, or Firm* — Oliff PLC

(57) ABSTRACT

A chip resistor is capable of improving surge characteristic while finely adjusting a resistance value with high accuracy. A chip resistor includes a resistor which is print-formed such that a first meandering portion is consecutively connected to a second meandering portion across a rectangular adjustment portion. The adjustment portion is provided with a first trimming groove to lengthen a current path of the resistor, thereby improving the surge characteristic while coarsely adjusting a resistance value of the resistor to bring it close to a target resistance value. Furthermore, a second trimming groove is provided in an area of the second meandering portion where a current distribution is small, thereby finely adjusting the resistance value of the resistor to make it coincide with the target resistance value in accordance with a cutting amount of the second trimming groove.

3 Claims, 4 Drawing Sheets

(56) References Cited

U.S. PATENT DOCUMENTS

| | | | | | |
|---|---|---|---|---|---|
| 4,306,217 | A * | 12/1981 | Solow | H01C 7/06 | 29/613 |
| 5,420,562 | A * | 5/1995 | Kaltenecker | H01C 7/003 | 338/293 |
| 6,084,502 | A * | 7/2000 | Ariga | H01C 17/242 | 338/195 |
| 7,286,039 | B2 * | 10/2007 | Yoneda | H01C 3/12 | 338/195 |
| 2004/0012479 | A1 | 1/2004 | Yamada et al. | | |
| 2016/0240291 | A1 * | 8/2016 | Tanaka | H01C 7/20 | |

* cited by examiner

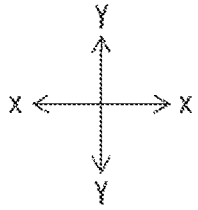
FIG. 2A
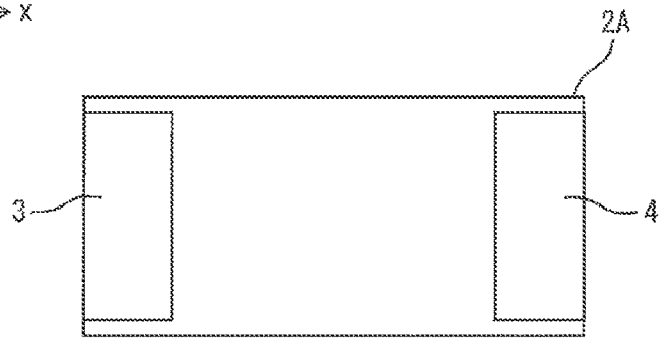
FIG. 2B
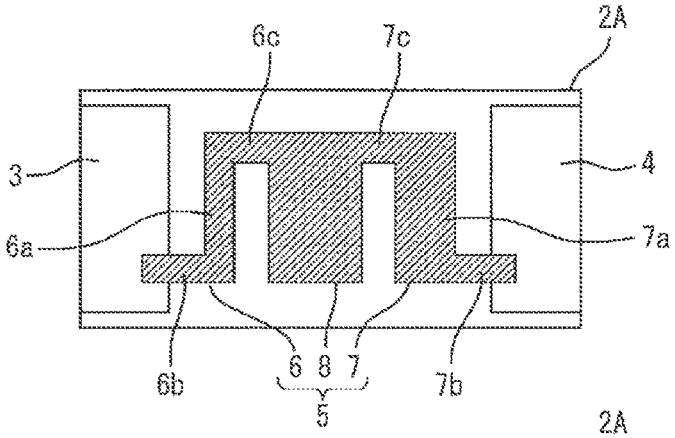
FIG. 2C
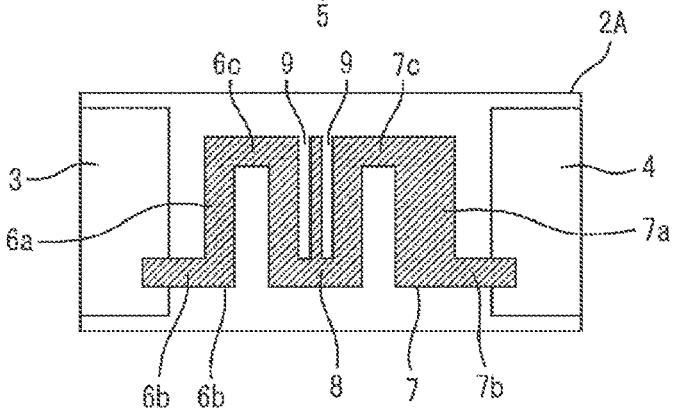
FIG. 2D
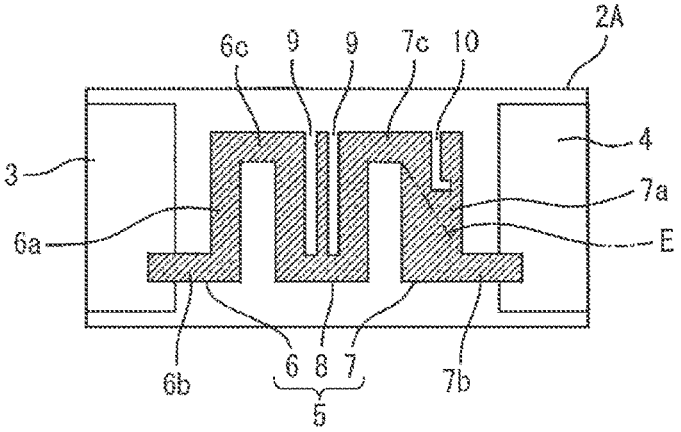

CHIP RESISTOR AND CHIP RESISTOR PRODUCTION METHOD

TECHNICAL FIELD

The present invention relates to a chip resistor in which trimming grooves are formed on a resistor provided on an insulating substrate so as to adjust a resistance value, and a manufacturing method thereof.

BACKGROUND ART

A chip resistor is configured to mainly include a rectangular parallelepiped insulating substrate, a pair of front electrodes oppositely disposed on a front surface of the insulating substrate with a predetermined interval therebetween, a pair of back electrodes oppositely disposed on a back surface of the insulating substrate with a predetermined interval therebetween, end face electrodes for bridging the front electrodes and the corresponding back electrodes, a resistor for bridging the pair of front electrodes, and a protective film for covering the resistor.

Generally, in a case of manufacturing this type of a chip resistor, after multi-piece electrodes, resistors, protective films, etc. are collectively formed on a large-sized substrate, the large-sized substrate is divided along grid-like division lines (for example, division grooves) to obtain multi-piece chip resistors. The process of manufacturing this type of the chip resistor includes the step of printing and sintering resistance paste on one of the surfaces of the large-sized substrate to obtain multi-piece chip resistors, which makes it difficult to avoid occurrence of a little variation in size and film thickness of each resistor due to such as positional deviation and bleeding during printing, or influence of temperature unevenness in a sintering furnace. Accordingly, a resistance value adjustment operation, in which trimming grooves are formed on each resistor in a state where they are on the large-sized substrate to set a resistance value to be a desired resistance value, is performed in the process above.

When surge voltage generated by static electricity, power supply noise, or the like is applied to the chip resistor configured as above, the characteristic of the resistor is affected by excessive electrical stress, and in the worst case, the resistor may be destroyed. It has been known that, in order to improve the surge characteristic, when the resistor is formed into a meander shape to lengthen the total length thereof, the potential drop becomes smooth and thus the surge characteristic can be improved.

As prior art of this type of a resistor, as illustrated in FIG. 4, there has been proposed a chip resistor manufactured by the steps of print-forming a resistor 102 which meanders and turns at two positions between a pair of front electrodes 101 provided at both ends of an insulating substrate 100, and then forming a single trimming groove 103 on the center of the resistor 102 according to a laser trimming method so as to obtain the resistor 102 which meanders and turns at three positions (see Patent Literature 1).

As another prior art, as illustrated in FIG. 5, there has been proposed a chip resistor in which, after print-forming a resistor 102, which includes rectangular portions 102*a* connected to a pair of front electrodes 101 and a substantially S-shaped portion 102*b* located between the rectangular portions 102*a*, between the pair of front electrodes 101 provided at both ends of an insulating substrate 100, trimming grooves 103 are formed into the rectangular portions 102*a* at both ends (see Patent Literature 2).

CITATION LIST

Patent Literature

Patent Literature 1: JP-A-H09-205004
Patent Literature 2: JP-A-2001-338801

SUMMARY OF INVENTION

Technical Problem

According to the prior art described in Patent Literature 1, since the total length of the resistor 102 is increased by using printing technique in combination with trimming work, it is possible to improve the surge characteristic. Furthermore, since formation of the trimming groove 103 also serves as adjustment of the resistance value, it is possible to improve accuracy of the resistance value. However, the trimming groove 103 is provided in a direction to narrow the cross-sectional area of current in the resistor 102, and accordingly, the amount of change in the resistance value which increases in accordance with increase in a cutting amount of the trimming groove 103 becomes large. In this way, in Patent Literature 1, although the accuracy of the resistance value can be improved to some extent, the resistance value cannot be finely adjusted with high accuracy.

On the other hand, according to the prior art described in Patent Literature 2, since each of the trimming grooves 103 can be provided in each of the rectangular portions 102*a* at both ends of the resistor 102 with the substantially S-shaped portion 102*b* interposed therebetween, an adjustment rate of the resistance value can be increased as compared with the chip resistor described in Patent Literature 1. However, the trimming grooves 103 of Patent Literature 2 are also provided in a direction to narrow the cross-sectional area of current in the resistor 102, and accordingly, the resistance value cannot be finely adjusted with high accuracy.

The present invention has been made in view of the circumstances of the prior art. A first object of the present invention is to provide a chip resistor capable of improving surge characteristic while finely adjusting a resistance value with high accuracy, and a second object is to provide a manufacturing method thereof.

Solution to Problem

In order to achieve the first object, the present invention provides a chip resistor comprising: an insulating substrate; a pair of electrodes which are oppositely disposed on the insulating substrate with a predetermined interval therebetween; and a resistor which bridges between the pair of electrodes, the resistor being provided with trimming grooves so as to adjust a resistance value, wherein the resistor comprises a print-forming body that consecutively connects the pair of electrodes, whereas the print-forming body having connecting portions each connected to the pair of electrodes and a rectangular shaped adjustment portion, whereas the adjustment portion is located between the connecting portions, at least one of the connecting portions is a turn-shaped meandering portion, a first trimming groove for coarse adjustment is provided in the adjustment portion to lengthen a current path of the resistor and a second trimming groove for fine adjustment is formed into the meandering portion, when referring to a direction between the pair of electrodes as an X direction and referring to a direction perpendicular to the X direction as a Y direction, the meandering portion includes an extending portion extending in the Y direction, an outer turn portion extending in the X direction to connect between one end of the extending portion and one of the pair of electrodes, and an inner turn portion extending in the X direction to connect between the other end of the extending portion and the adjustment portion, the second trimming groove extends in the Y direction from one of the outer turn portion and the inner turn portion as a starting end position, and a distal end of the second trimming groove does not reach an imaginary line connecting the outer turn portion and the inner turn portion at a shortest distance.

According to the chip resistor configured as above, since the first trimming groove is provided in the adjustment portion to lengthen the current path of the resistor, the resistance value is increased in accordance with increase in a cutting amount of the first trimming groove. As a result, it is possible to improve the surge characteristic while coarsely adjusting the resistance value. Furthermore, since the second trimming groove is provided in an area of the meandering portion in which a current distribution is small, it is possible to finely adjust the resistance value with high accuracy.

In the chip resistor configured as above, only one of the two connecting portions connected to the pair of electrodes may be a turn-shaped meandering portion. Meanwhile, it is preferable when both the two connecting portions are meandering portions having the turn-shape and the second trimming groove is provided in one of the meandering portions. With this configuration, the total length of the resistor becomes large, thereby further improving the surge characteristic.

In order to achieve the second object, the present invention provides a manufacturing method of a chip resistor, the chip resistor including an insulating substrate, a pair of electrodes which are oppositely disposed on the insulating substrate with a predetermined interval therebetween; and a resistor which bridges between the pair of electrodes, the resistor being provided with trimming grooves so as to adjust a resistance value, wherein the resistor comprises a print-forming body that consecutively connects the pair of electrodes, whereas the print-forming body having connecting portions each connected to the pair of electrodes and a rectangular shaped adjustment portion, whereas the adjustment portion is located between the connecting portions, at least one of the connecting portions is a turn-shaped meandering portion, and when referring to a direction between the pair of electrodes as an X direction and referring to a direction perpendicular to the X direction as a Y direction, the meandering portion includes an extending portion extending in the Y direction, an outer turn portion extending in the X direction to connect between one end of the extending portion and one of the pair of electrodes, and an inner turn portion extending in the X direction to connect between the other end of the extending portion and the adjustment portion, the manufacturing method comprising the steps of: forming a first trimming groove for coarse adjustment in the adjustment portion to lengthen a current path of the resistor; forming a second trimming groove for fine adjustment which extends in the Y direction from one of the outer turn portion and the inner turn portion as a starting end position, and setting a distal end of the second trimming groove to a position which does not reach an imaginary line connecting the outer turn portion and the inner turn portion at a shortest distance.

In the manufacturing method of a chip resistor including the steps described above, after print-forming the resistor having a meander shape in which at least one meandering portion is consecutively connected to the adjustment portion, a first trimming groove is provided in the adjustment portion to lengthen the current path of the resistor. With this configuration, the resistance value is increased in accordance with increase in the cutting amount of the first trimming groove, and accordingly, it is possible to coarsely adjust the resistance value while improving the surge characteristic. Furthermore, since the second trimming groove is provided in an area of one of the meandering portions in which the current distribution is small after forming the first trimming groove, it is possible to finely adjust the resistance value with high accuracy.

Advantageous Effects of Invention

According to the present invention, it is possible to provide a chip resistor capable of improving surge characteristic while finely adjusting a resistance value with high accuracy.

BRIEF DESCRIPTION OF DRAWINGS

FIG. 2 explains a process of manufacturing a chip resistor according to the first embodiment.

DESCRIPTION OF EMBODIMENTS

Hereinafter, embodiments of the present invention will be described with reference to the drawings.

Figure 1:
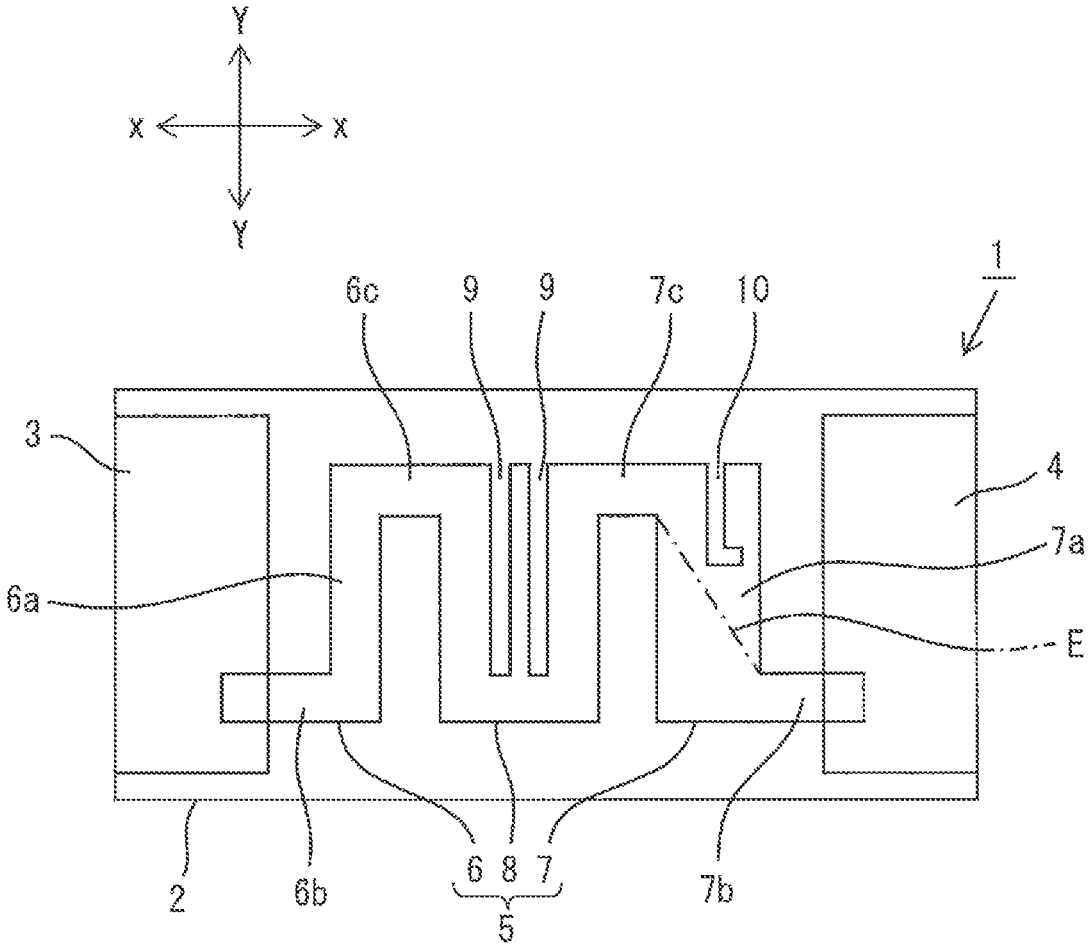
FIG. 1 is a plan view of a chip resistor according to a first embodiment of the present invention.

FIG. 1 is a plan view of a chip resistor according to a first embodiment of the present invention. As illustrated in FIG. 1, a chip resistor 1 according to the first embodiment is configured to mainly include a rectangular parallelepiped insulating substrate 2, a first front electrode 3 and a second front electrode 4 provided on both ends of a front surface of the insulating substrate 2 in its longitudinal direction, a resistor 5 provided on the front surface of the insulating substrate 2 so as to connect the pair of front electrodes 3, 4, and a protective coating layer (not illustrated) provided so as to cover the resistor 5. Although not illustrated in the drawings, on a back surface of the insulating substrate 2, a pair of back electrodes is provided to correspond to the front electrodes 3, 4, and on both end faces of the insulating substrate 2 in its longitudinal direction, end face electrodes for bridging the front electrodes and the corresponding back electrodes are provided.

The resistor 5 is formed into a meander shape, in which a first meandering portion 6 and a second meandering portion 7 at both ends are consecutively connected across an adjustment portion 8 located at the center. The meander shape described above is defined by printing of resistor paste. In FIG. 1, when referring to a direction between the first and second front electrodes 3, 4 as an X direction and referring to a direction perpendicular to the X direction as a Y direction, the first meandering portion 6 includes an extending portion **6*a* extending in the Y direction, an outer turn portion 6***b* extending in the X direction to connect between a lower end of the extending portion 6*a* and the first front electrode 3 illustrated on the left side of FIG. 1, and an inner turn portion 6*c* extending in the X direction to connect between an upper end of the extending portion 6*a* and the adjustment portion 8. The pattern size of the extending portion 6*a*, the outer turn portion 6*b*, and the inner turn portion 6*c* are the same thereamong.

The second meandering portion 7 includes an extending portion 7*a* extending in the Y direction, an outer turn portion 7*b* extending in the X direction to connect between a lower end of the extending portion 7*a* and the second front electrode 4 illustrated on the right side of FIG. 1, and an inner turn portion 7*c* extending in the X direction to connect between an upper end of the extending portion 7*a* and the adjustment portion 8. The pattern width of the outer turn portion 7*b* and the inner turn portion 7*c* is set to be the same as that of the first meandering portion 6. On the other hand, the pattern width of the extending portion 7*a* is set to be larger (about twice) than that of the extending portion 6*a* of the first meandering portion 6.

The adjustment portion 8 is formed into a rectangular shape, and the pattern width thereof is larger than the pattern width of the first meandering portion 6 and the second meandering portion 7. The inner turn portion 6*c* of the first meandering portion 6 and the inner turn portion 7*c* of the second meandering portion 7 are connected to mutually opposing upper end sides of the adjustment portion 8. The adjustment portion 8 is provided with two first trimming grooves 9 which are formed along the Y direction from the upper side of the adjustment portion 8. The first trimming grooves 9 are extended to form an I-cut shape so as to lengthen a current path of the resistor 5, whereby a resistance value of the resistor 5 is coarsely adjusted to bring it close to a target resistance value. In the case of forming the first trimming grooves 9 in the adjustment portion 8, since the resistor 5 which has been formed into a printed shape having the two meandering portions 6, 7 is further meandered and thus turns at three times in total, the total length of the resistor 5 can be increased by the amount of turn.

Here, the number of the first trimming grooves 9 to be provided in the adjustment portion 8 is not limited to two, and may be one or more than three. In such a case, when forming the one or more first trimming grooves 9 so that the current path of the adjustment portion 8 with the one or more first trimming grooves 9 is larger than the minimum pattern width of a current path (6*a*,6*b*,6*c*,7*b*,7*c*) which does not have any trimming grooves defined by printing, load in the pattern can be concentrated on portions formed by printing. Accordingly, even when microcracks are generated in the first trimming grooves 9, it is possible to reduce an adverse effect on a resistance value.

Furthermore, the second meandering portion 7 is provided with a second trimming groove 10 which is formed into an L-cut shape from an upper side of the inner turn portion 7*c* toward the inside of the extending portion 7*a*. A distal end of the second trimming groove 10 is set to a position which does not cross over an imaginary line E connecting the outer turn portion 7*b* and the inner turn portion 7*c* at the shortest distance. Here, a portion where current flows the most in the extending portion 7*a* is the imaginary line E, and the second trimming groove 10 is provided in an area of the second meandering portion 7 in which current distribution is small. Accordingly, a change amount of the resistance value corresponding to a cutting amount of the second trimming groove 10 is very small. As a result, the resistance value of the resistor 5 can be finely adjusted with high accuracy by the second trimming groove 10 so as to be made coincide with the target resistance value.

The shape of the second trimming groove 10 is not limited to the L-cut shape, and may be an I-cut shape. In such a case, when forming the second trimming groove 10 so that a current path of the extending portion 7*a* of the second meandering portion 7 with the second trimming groove 10 is larger than the minimum pattern width of the current path (6*a*,6*b*,6*c*,7*b*,7*c*) which does not have any trimming grooves defined by printing, load in the pattern can be concentrated on portions formed by printing. Accordingly, even when microcracks are generated in the first trimming grooves 9, it is possible to reduce an adverse effect on a resistance value.

Next, a manufacturing process of the chip resistor 1 configured as above will be described with reference to FIG. 2.

The first step of the manufacturing process of the chip resistor 1 is to prepare a large-sized substrate from which multi-piece insulating substrates 2 are obtained. In the large-sized substrate, primary division grooves and secondary division grooves extending in longitudinal and lateral directions are provided in advance to form a grid pattern, and each one of the grids divided by the primary dividing grooves and the secondary dividing grooves serves as a single chip region. FIG. 2 illustrates a large-sized substrate 2A corresponding to a single chip region as a representative, but practically, each step described below is collectively performed with respect to a large-sized substrate corresponding to multi-piece chip regions.

That is, as illustrated in FIG. 2(*a*), after screen-printing Ag-based paste on a front surface of the large-sized substrate 2A, the step of drying and sintering the screen-printed paste is performed to form the first front electrode 3 and the second front electrode 4 (front electrodes forming step). Simultaneously with or around the front electrodes forming step, after screen-printing the Ag-based paste on a back surface of the large-sized substrate 2A, the step of drying and sintering the screen-printed paste is performed to form the pair of back electrodes (not illustrated) (back electrodes forming step).

As illustrated in FIG. 2B, the next step is to screen-print resistor paste such as Cu—Ni or ruthenium oxide on the front surface of the large-sized substrate 2A, and then dry and sinter the screen-printed paste to form the resistor 5 of which both ends in its longitudinal direction respectively overlap with the first front electrode 3 and the second front electrode 4 (resistor forming step). The resistor 5 includes the first meandering portion 6 connected to the first front electrode 3, the second meandering portion 7 connected to the second front electrode 4, and the rectangular adjustment portion 8 located between the first front electrode 3 and the second front electrode 4. The first front electrode 3, the second front electrode 4, and the adjustment portion 8 are consecutively connected with each other to formed a meander shape.

Here, in FIG. 2, when referring to an extending direction of the secondary division grooves as an X direction and referring to an extending direction of the primary division grooves as a Y direction, the first meandering portion 6 includes the extending portion 6*a* extending in the Y direction, the outer turn portion 6*b* extending in the X direction to connect between the lower end of the extending portion 6*a* and the first front electrode 3 illustrated on the left side of FIG. 2, and the inner turn portion 6*c* extending in the X direction to connect between the upper end of the extending portion 6*a* and an upper left end of the adjustment portion 8. The second meandering portion 7 includes the extending portion 7*a* extending in the Y direction, the outer turn portion 7*b* extending in the X direction to connect between the lower end of the extending portion 7*a* and the second front electrode 4 illustrated on the right side of FIG. 2, and the inner turn portion 7*c* extending in the X direction to connect between the upper end of the extending portion 7*a* and an upper right end of the adjustment portion 8.

Next, after forming a pre-coat layer (not illustrated) for covering the resistor 5 by screen-printing glass paste over the resistor 5 and drying and sintering the printed glass paste, a step for irradiating a laser beam from above the pre-coat layer is performed to form the two I-cut shaped first trimming grooves 9 in the adjustment portion 8 (first trimming forming step) as illustrated in FIG. 2C so as to coarsely adjust the resistance value of the resistor 5 to a value slightly lower than the target resistance value. The first trimming grooves 9 are formed to extend in the Y direction from the upper side of the adjustment portion 8 to the lower side thereof. Since the first trimming grooves 9 formed as above are provided in the adjustment portion 8, the current path of the resistor 5 is lengthened as whole. Accordingly, at this step, the resistor 5 which has been formed into a printed shape having the two meandering portions 6, 7 is further meandered and thus turned at three times in total. In this connection, the number of the first trimming grooves 9 to be provided in the adjustment portion 8 is not limited to two, and may be one or more than three.

Subsequently, as illustrated in FIG. 2D, the step of forming the second trimming groove 10 having the L-cut shape in the second meandering portion 7 (second trimming forming step) is performed so as to finely adjust the resistance value of the resistor 5 to make it coincide with the target resistance value. The second trimming groove 10 is formed to extend in the Y direction from the upper side of the extending portion 7*a* to the lower side thereof. At this time, care is taken so that the distal end of the second trimming groove 10 does not cross over the imaginary line E connecting the outer turn portion 7*b* and the inner turn portion 7*c* at the shortest distance. Here, a portion where the second trimming groove 10 is formed is an area of the second meandering portion 7 in which the current distribution is small, and accordingly, a resistance value change amount per a trimming amount in this area is very small. As a result, the resistance value of the resistor 5 can be finely adjusted with high accuracy by the second trimming groove 10. In this connection, as long as the distal end of the second trimming groove 10 does not cross over the imaginary line E, the shape of the second trimming groove 10 is not limited to the L-cut shape, and may be an I-cut shape.

Next, the step of screen-printing epoxy resin paste over the first trimming groove 9 and the second trimming groove 10 and heating and curing the screen-printed paste is performed so as to form the protective coating layer (not illustrated) for covering the whole of the resistor 5 (protective coating layer forming step).

The steps up to here are collectively performed with respect to the large-sized substrate 2A from which multi-piece insulating substrates are obtained. In the next step, primary break processing for dividing the large-sized substrate 2A into strips along the primary division grooves is performed so as to obtain strip-shaped substrates (not illustrated) provided with multi-piece chip regions (primary dividing step). Then, the step of applying the Ag paste on divided surfaces of the strip-shaped substrate and then drying and sintering the applied paste, or sputtering Ni/Cr thereon instead of the Ag paste is performed so as to form end face electrodes (not illustrated) for bridging the first and second front electrodes 3, 4 and the corresponding back electrodes (end face electrode forming step).

Thereafter, secondary break processing for dividing the strip-shaped substrate along the secondary division grooves is performed to obtain a chip unit having the same dimension as that of the chip resistor 1 (secondary dividing step). The final step is to apply electrolytic plating such as Ni, Au, or Sn on both of the end faces of the insulating substrate 2 in its longitudinal direction for each divided chip unit so as to form an external electrode (not illustrated) for covering the end face electrodes, the back electrodes, and the first and second front electrodes 3, 4 exposed from the protective film. In this way, the chip resistor 1 as illustrated in FIG. 1 can be obtained.

As described above, according to the chip resistor 1 of the first embodiment, after print-forming the resistor 5 having the meander shape in which the first meandering portion 6 is consecutively connected to the second meandering portion 7 across the rectangular shaped adjustment portion 8, the step of forming the first trimming grooves 9 in the adjustment portion 8 is performed. As a result, it is possible to lengthen the current path of the resistor 5 and improve the surge characteristics while coarsely adjusting the resistance value of the resistor 5 so as to bring it close to the target resistance value. Furthermore, thereafter, by forming the second trimming groove 10 in an area of the second meandering portion 7 where the current distribution is small, the resistance value of the resistor can be finely adjusted to be made coincide with the target resistance value in accordance with the cutting amount of the second trimming groove 10. As a result, it is possible to adjust the resistance value with high accuracy while improving the surge characteristics.

Figure 3:
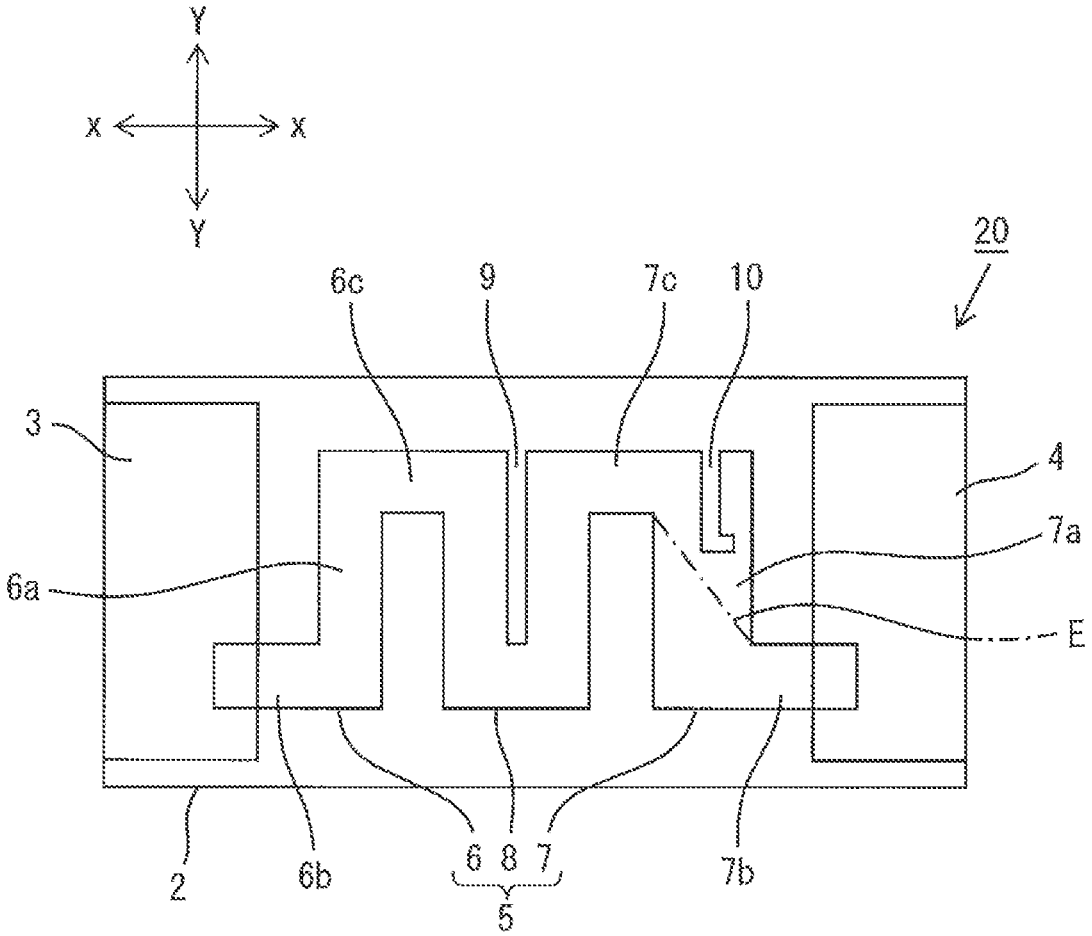
FIG. 3 is a plan view of a chip resistor according to a second embodiment of the present invention.
Figure 4:
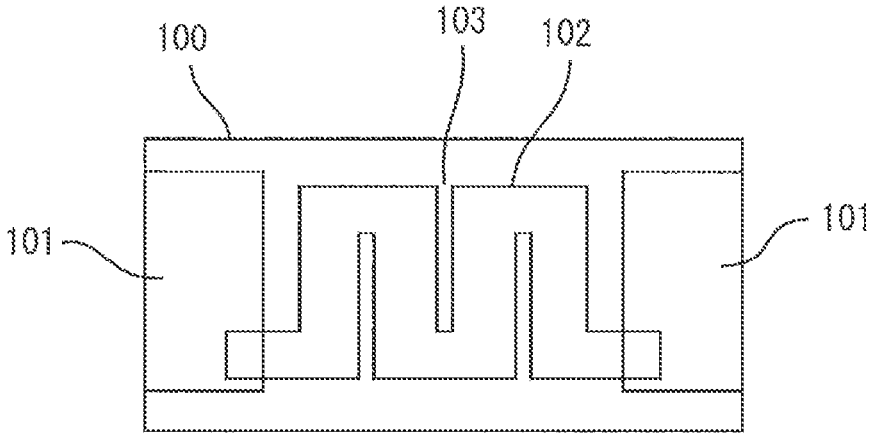
FIG. 4 is a plan view of a chip resistor according to prior art.
Figure 5:
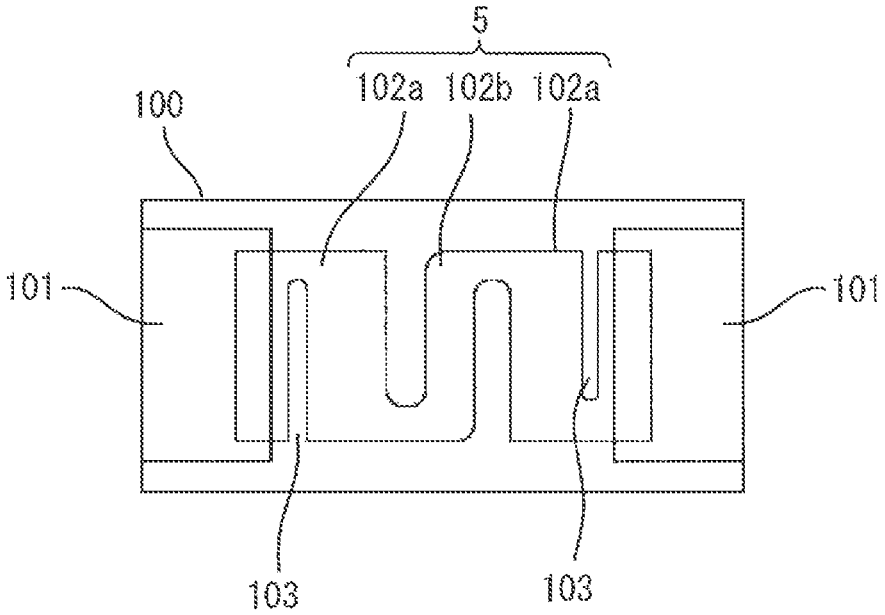
FIG. 5 is a plan view of a chip resistor according to another prior art.

FIG. 3 is a plan view of a chip resistor 20 according to a second embodiment of the present invention. Elements corresponding to those in FIG. 1 are provided with the same reference signs, and repetitive explanation thereof will be properly omitted.

The second embodiment differs from the first embodiment in that the pattern width of the adjustment portion 8 which is narrowed by formation of the first trimming grooves 9 is made substantially the same as the pattern of the first meandering portion 6. The configuration of the chip resistor 20 other than the above is basically the same as that of the chip resistor 1 illustrated in FIG. 1.

That is, as illustrated in FIG. 3, the first groove 9 is formed at one part of the adjustment portion 8 which was printed in the rectangular shape, and accordingly, the adjustment portion 8 is formed into the meander shape. When referring to the pattern width of the first meandering portion 6 as W, the width dimension of the adjustment portion 8 before being provided with the first trimming groove 9 is about 2 W. In the second embodiment, by forming the first trimming groove 9 having the I-cut shape to coarsely adjust the resistance value, the adjustment portion 8 having the rectangular shape is formed into the meander shape, thereby making the width dimension of the adjustment portion 8 about half, which is i.e., W.

According to the chip resistor 20 of the second embodiment configured as above, since the first trimming groove 9 is formed in the adjustment portion 8 printed in the rectangular shape, the pattern width is made substantially the same as the width W from the first meandering portion 6 to the inner turn portion 7*c* of the second meandering portion 7 through the adjustment portion 8. With this configuration, it is possible to distribute hot spots, thereby realizing equalization of the entire pattern of the resistor 5.

In the chip resistor 20 according to the second embodiment, the number of the first trimming groove 9 to be provided in the adjustment portion 8 may be two or more. In such a case, the width dimension of the adjustment portion 8 may be changed at the time of print-forming in accordance with the number of the first trimming groove 9.

Furthermore, in each of the embodiments described above, the second trimming groove 10 is provided in the second meandering portion 7 from the upper side of the inner turn portion 7*c* to the inside of the extending portion 7*a*. Meanwhile, as long as the distal end of the second trimming groove 10 does not cross over the imaginary line E connecting the outer turn portion 7*b* and the inner turn portion 7*c* at the shortest distance, the second trimming groove 10 may be provided in the second meandering portion 7 from a lower side of the outer turn portion 7*b* to the inside of the extending portion 7*a*.

Still further, in each of the embodiments described above, an example in which the second trimming groove 10 is provided in the second meandering portion 7 connected to the second front electrode 4, which is consecutively connected to the first meandering portion 6 across the adjustment portion 8, has been described. Meanwhile, the second trimming groove 10 may be provided in the first meandering portion 6 connected to the first front electrode 3 to finely adjust the resistance value. In such a case, it is preferable to set the pattern width of the extending portion 6*a* of the first meandering portion 6 larger than the pattern width of the extending portion 7*a* of the second meandering portion 7.

Still further, in each of the embodiments described above, as each connecting portion of the resistor 5 respectively connected to the first front electrode 3 and the second front electrode 4, the first meandering portion 6 and the second meandering portion 7 both having a turn-shape are employed. Meanwhile, as either one of the connecting portions, a connecting portion having a straight shape, without being bended in the turn shape, may be employed. That is, the chip resistor 1 illustrated in FIG. 1 may be formed without the extending portion 6*a* and the outer turn portion 6*b* of the first meandering portion 6 but so as to connect between the first front electrode 3 and the adjustment portion 8 by using the inner turn portion 6*c* extending in the X direction.

REFERENCE SIGNS LIST

1, 20 chip resistor
2 insulating substrate
2A large-sized substrate
3 first front electrode
4 second front electrode
5 resistor
6 first meandering portion
6*a* extending portion
6*b* outer turn portion
6*c* inner turn portion
7 second meandering portion
7*a* extending portion
7*b* outer turn portion
7*c* inner turn portion
8 adjustment portion
9 first trimming groove
10 second trimming groove
E imaginary line connecting outer turn portion and inner turn portion at shortest distance

The invention claimed is:

1. A chip resistor comprising:

an insulating substrate;

a pair of electrodes which are oppositely disposed on the insulating substrate with a predetermined interval therebetween; and a resistor which bridges between the pair of electrodes, the resistor being provided with trimming grooves so as to adjust a resistance value, wherein the resistor comprises a print-forming body that consecutively connects the pair of electrodes, whereas the print-forming body having connecting portions each connected to the pair of electrodes and a rectangular shaped adjustment portion, whereas the adjustment portion is located between the connecting portions, at least one of the connecting portions is a turn-shaped meandering portion, a first trimming groove for coarse adjustment is provided in the adjustment portion to lengthen a current path of the resistor and a second trimming groove for fine adjustment is provided in the meandering portion, when referring to a direction between the pair of electrodes as an X direction and referring to a direction perpendicular to the X direction as a Y direction, the meandering portion includes an extending portion extending in the Y direction, an outer turn portion extending in the X direction to connect between one end of the extending portion and one of the pair of electrodes, and an inner turn portion extending in the X direction to connect between the other end of the extending portion and the adjustment portion, the second trimming groove extends in the Y direction from one of the outer turn portion and the inner turn portion as a starting end position, and a distal end of the second trimming groove does not reach an imaginary line connecting the outer turn portion and the inner turn portion at a shortest distance.

2. The chip resistor according to claim 1, wherein both of the connecting portions are turn-shaped meandering portions, and the second trimming groove is provided in one of the meandering portions.

3. A manufacturing method of a chip resistor, the chip resistor including an insulating substrate, a pair of electrodes which are oppositely disposed on the insulating substrate with a predetermined interval therebetween; and a resistor which bridges between the pair of electrodes, the resistor being provided with trimming grooves so as to adjust a resistance value, wherein the resistor comprises a print-forming body that consecutively connects the pair of electrodes, whereas the print-forming body having connecting portions each connected to the pair of electrodes and a rectangular shaped adjustment portion, whereas the adjustment portion is located between the connecting portions, at least one of the connecting portions is a turn-shaped meandering portion, and when referring to a direction between the pair of electrodes as an X direction and referring to a direction perpendicular to the X direction as a Y direction, the meandering portion includes an extending portion extending in the Y direction, an outer turn portion extending in the X direction to connect between one end of the extending portion and one of the pair of electrodes, and an inner turn portion extending in the X direction to connect between the other end of the extending portion and the adjustment portion, the manufacturing method comprising the steps of:

forming a first trimming groove for coarse adjustment in the adjustment portion to lengthen a current path of the resistor;

forming a second trimming groove for fine adjustment which extends in the Y direction from one of the outer turn portion and the inner turn portion as a starting end position, and setting a distal end of the second trimming groove to a position which does not reach an imaginary line connecting the outer turn portion and the inner turn portion at a shortest distance.

* * * * *